US007656642B2

(12) United States Patent
Ulekleiv et al.

(10) Patent No.: US 7,656,642 B2
(45) Date of Patent: Feb. 2, 2010

(54) MEANS AND METHOD FOR REDUCING BUILD-UP OF ELECTROSTATIC CHARGES IN A FLUID CONTAINER

(75) Inventors: Rune Ulekleiv, Gjøvik (NO); Arild Hansen, Raufoss (NO)

(73) Assignee: Ragasco AS, Raufoss (NO)

( * ) Notice: Subject to any disclaimer, the term of this patent is extended or adjusted under 35 U.S.C. 154(b) by 41 days.

(21) Appl. No.: 10/599,094

(22) PCT Filed: Mar. 14, 2005

(86) PCT No.: PCT/NO2005/000089

§ 371 (c)(1),
(2), (4) Date: May 2, 2007

(87) PCT Pub. No.: WO2005/090843

PCT Pub. Date: Sep. 29, 2005

(65) Prior Publication Data

US 2008/0043398 A1 Feb. 21, 2008

(30) Foreign Application Priority Data

Mar. 19, 2004 (NO) ..... 20041198

(51) Int. Cl.
*H05F 3/00* (2006.01)

(52) U.S. Cl. ..... 361/215; 361/212; 361/213; 361/214; 361/216; 361/217; 361/218; 220/4.12; 220/4.13; 220/4.14; 220/567.2

(58) Field of Classification Search ..... 361/212, 361/215–218; 220/567.2, 4.12, 4.13, 4.14
See application file for complete search history.

(56) References Cited

U.S. PATENT DOCUMENTS

| | | | | | |
|---|---|---|---|---|---|
| 3,625,264 | A * | 12/1971 | Swain | ..... | 141/198 |
| 3,643,707 | A * | 2/1972 | Ensign | ..... | 141/286 |
| 3,965,947 | A * | 6/1976 | Easton et al. | ..... | 141/207 |
| 4,540,191 | A * | 9/1985 | Hoch | ..... | 280/834 |
| 4,862,316 | A * | 8/1989 | Smith et al. | ..... | 361/220 |
| 7,042,695 | B2 * | 5/2006 | Przytulla et al. | ..... | 361/215 |
| 2004/0218336 | A1 * | 11/2004 | Schutz | ..... | 361/215 |

* cited by examiner

*Primary Examiner*—Fritz M Fleming
*Assistant Examiner*—Terrence R Willoughby
(74) *Attorney, Agent, or Firm*—Rothwell, Figg, Ernst & Manbeck, PC

(57) ABSTRACT

The invention relates to a means for preventing build-up of electrostatic potential in a fluid container during filling and/or discharging. The fluid container comprises electrical insulating materials and a valve means through which filling and/or discharging occurs. Means for reducing and/or eliminating electrical and/or electrostatic potential build-up during filling or discharging of the container is arranged in conjunction with the container walls. Such means may for example be arranged in conjunction with the valve means, reducing and/or changing the flow velocity of the fluid and/or the flow direction of the fluid during the filling operation. The invention relates also to a method of avoiding build-up of electrical and/or electrostatic potential, the method comprising changing the direction of fluid flow at least once at the top end of the container, so that the flow of fluid into the container preferably becomes laminar and/or is depressurized and wherein the fluid flow velocity into the container is reduced.

11 Claims, 2 Drawing Sheets

MEANS AND METHOD FOR REDUCING BUILD-UP OF ELECTROSTATIC CHARGES IN A FLUID CONTAINER

CROSS REFERENCE TO RELATED APPLICATION(S)

This application is a 35 U.S.C. §371 National Phase Entry Application from PCT/NO2005/000089, filed Mar. 14, 2005, and designating the United States.

The present invention relates to means for reducing or preventing build-up of electrostatic charges in a fluid container during filling of a fluid, such as propane, butane and CNG. The fluid container comprises electrically insulating material and a valve means for filling and discharging fluid from the container.

Electrostatic charges occur normally when a gas/liquid is flowing through a tube, valve or past other types of obstacles. When the charge is built up on an insulated surface, the charge will establish an electrical field which, if sufficiently large, will cause a discharge in the form of spark formation, if coming into contact with a conducting antipode contacting the container. The size and intensity of the discharge depend on the accumulated energy, which depend on the total charge being released. The minimum charge energy for propane will for example be 0.25 mJ for a stoichiometric mixture of 4% propane in air.

The Applicants own European Patent No. EP 0958473 discloses a pressure container for storage of fluids, such as propane. The container comprises an inner, fluid tight container and an outer, protective casing. The inner pressure container is made of a transparent and/or translucent material, whereby the liquid level of the inner container may be observed from the outside. The outer casing comprises a middle section having surface portions being cut-away, so that the liquid level inside the inner container also may be observed through the casing. Such type of containers and/or casings is made of a thermo-plastic material and composite material, comprising thermoplastic materials such as PET, PE, PA.

Compared to a pressure container of metal, and provided the metal containers are earthed, pressure containers made of plastic materials do not conduct electrical and/or static potentials as good as steel containers. Such static electricity may build-up occasionally in containers of plastic materials, for example during filling of the liquid into the container. In particular, build-up of static electricity may occur during filling of the container for the first time. At such stage the container is completely empty and there exist no partial liquid pressure inside the container. Consequently, built-up of static electricity may more easily occur in containers of plastic materials when the liquid internally hit the plastic material in the container.

The stronger jet, the drier air, the faster filling rate, and the higher filling velocity and pressure in the jet of fluid impacting the container wall, the higher will the electrostatic build-up be. The static charge is caused inter alia because of the friction between the jet and the container wall.

One possibility of preventing build-up of electrical potential in the container is to discharge the potential, for example by earthing the internal container during filling or by ensuring that the inner container wall is wetted prior to filling. Provided the container is earthed, such potential does not represent a problem in metal containers since the metal material in the container readily discharge the potential. For containers of plastic materials, however, build-up of static electricity may occur. Since discharge of the potential during filling operation may occur, causing the possibility of formation of sparks, the presence of such potential should be avoided.

An objective of the present invention is to ensure that flow of fluid into the container does not cause build-up of electric and/or electrostatic charges which may produce sparks igniting the gas, in particular during filling of the container.

According to the invention, the objective is achieved by means of a method and a valve means as further defined in the patent claims below.

According to the invention, a filling process is achieved in which the velocity of flow is reduced and/or that the direction of flow is changed during the filling operation without increasing the total time required for filling the container.

Further, a safe method of filling combustible or inflammable fluids, such as liquid propane, butane, CNG or the like, is obtained.

The invention will be described below in further details referring to the drawings, in which.

Figure 1:
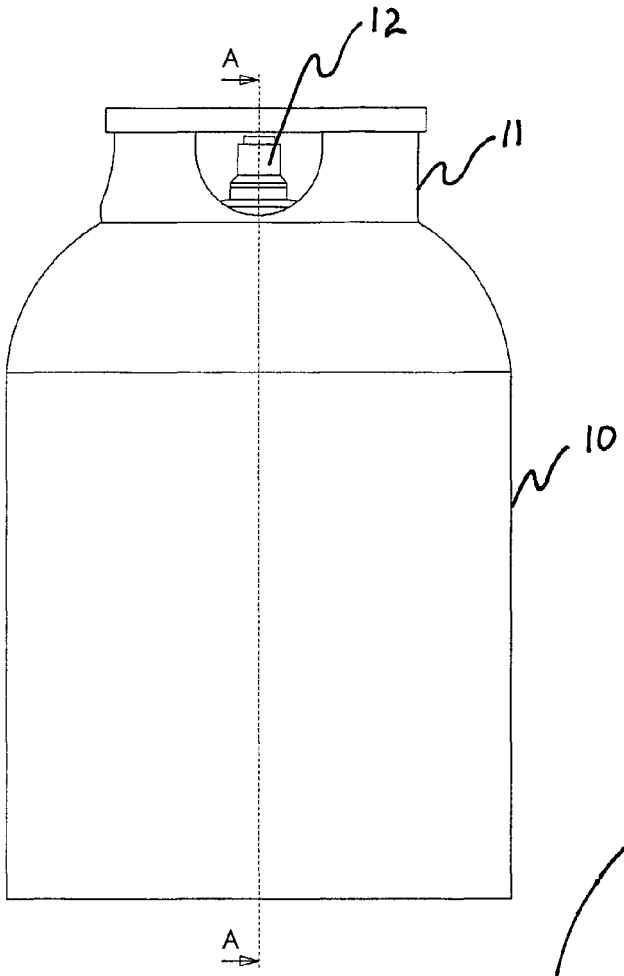
FIG. 1 shows a side view of a container provided with a valve means according to the present invention.

FIG. 1 shows a schematic view of a container 10 for liquid propane or corresponding fluids. At its upper end, as indicated in the Figure, the container 10 is provided with a handle 11 for handling the container 10. Further, a charging and discharging valve 12 is shown, centrally arranged at the upper end of the container 10.

Figure 2:
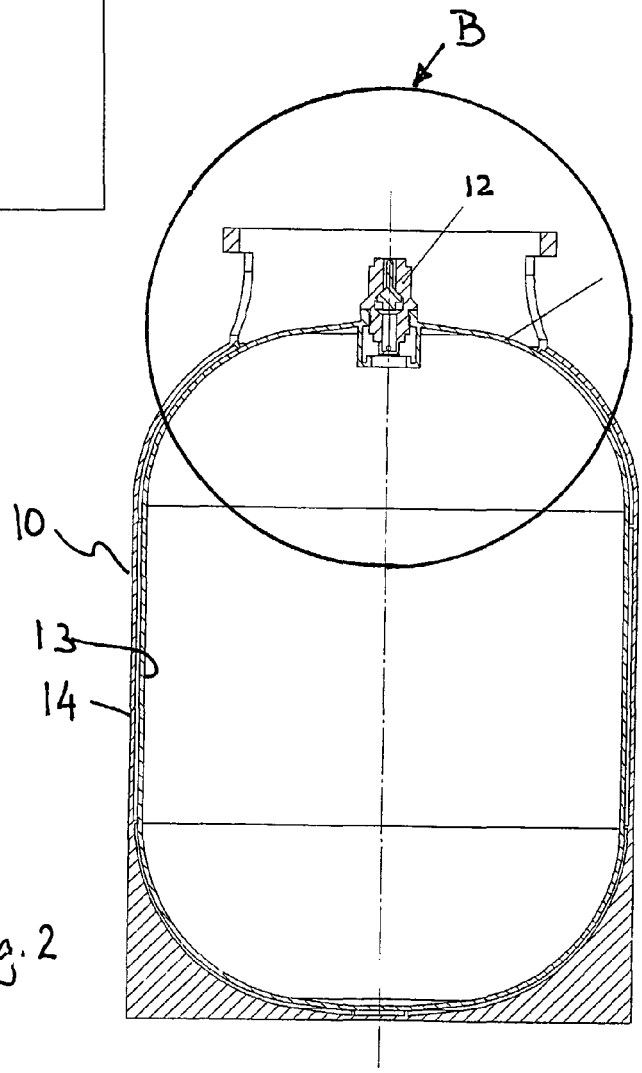
FIG. 2 shows a vertical section through the valve means according to the invention, seen along the line A-A in FIG. 1.

FIG. 2 shows a vertical section through the container 10 shown in FIG. 1. According to the embodiment shown in FIG. 2, the container 10 is formed of an inner, pressure and fluid tight part 13 made of plastic materials, such as for example an inner liner and a surrounding layer of composite materials. Alternatively, the inner part 13 may for example be made of a composite material without an inner liner.

According to the embodiment shown, the container 10 may further be provided with an external casing 14, surrounding the inner part. The handle 11 is formed as an extension of the surrounding casing 14. The casing 14 may for example be formed of two or more parts, assembled in any known manner to form an integral casing.

Figure 3:
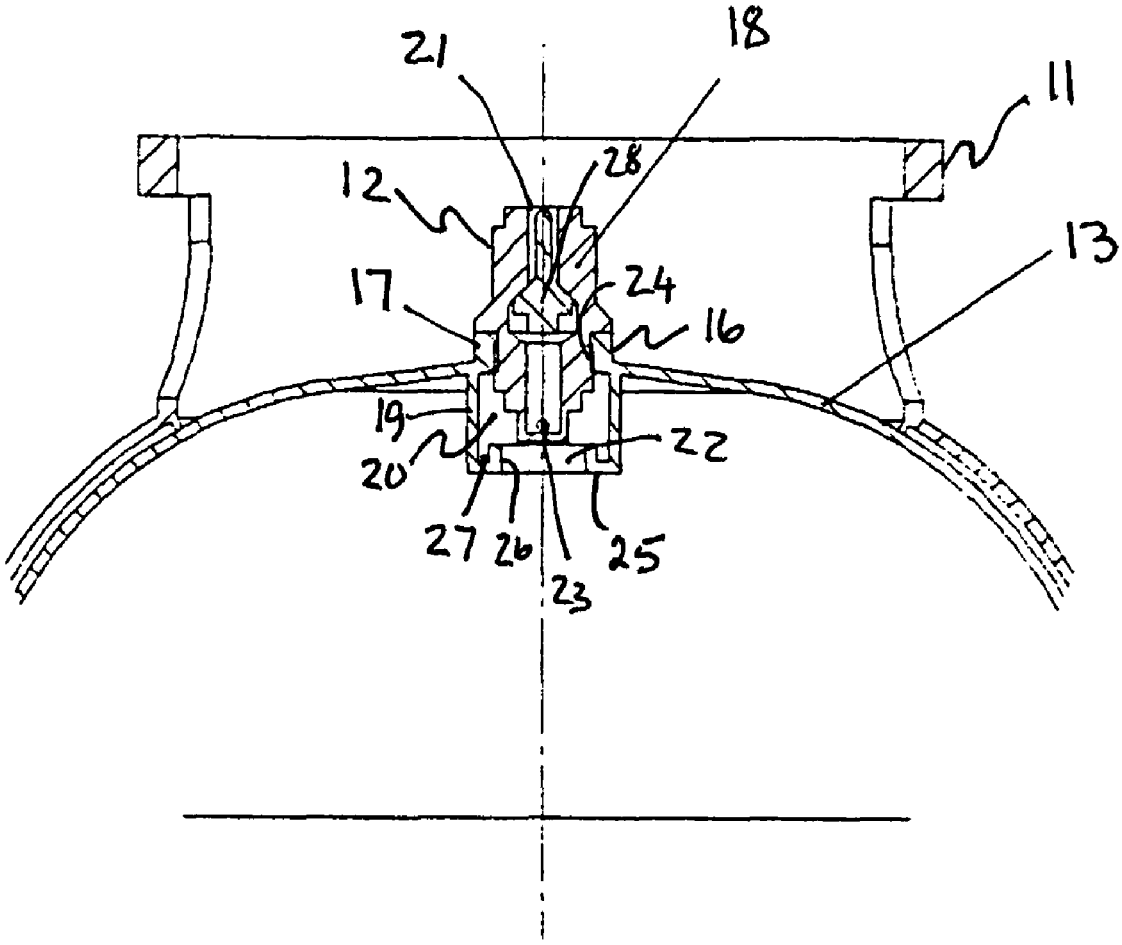
FIG. 3 shows, in an enlarged scale, the valve means indicated by the detail B in FIG. 2.

A preferred embodiment of the valve 12 according to the invention is shown in FIG. 2 and on an enlarged scale in FIG. 3. As shown in the FIGS. 2 and 3, the inner part 13 of the container 10 is provided with a boss 16 at its upper end. The boss 16 is designed with an upwards protruding cylindrical part 17 for housing a valve means 18.

A cavity 20 is associated with the boss 16. According to the embodiment shown, such cavity 20 is formed by a downwards protruding tube shaped part 19, protruding into the inner pressure tight part 13.

At its lower end, the downwards protruding tube shaped part 19 is provided with one or more openings 22 extending into the inner part 13 of the container 10. The opening(s) may either be arranged in a bottom plate 25 of the downwards protruding part 19, such as shown in FIGS. 2 and 3, or the openings may be arranged in the side wall of the downwards protruding tube shaped part 19.

The valve means 18 is formed with a preferably vertical bore 21 through the valve means 18, the bore of the valve means 18 being closed at its lower end. At said lower end the valve means 18 is provided with a plurality of openings 23, preferably extending laterally, forming an angle with the vertical bore 21 and communicating with said bore 21. The number of plurality of openings 23 may for example be three or four. It should be appreciated, however, that the number may vary, provided that at least one change of direction of the fluid flow during the filling stage is achieved.

The lower end of the valve means 18 extends preferably into the cavity 20 and the openings 23 of the valve means may possibly be arranged at a higher level than the opening(s) 22 in the cavity 20/the tube shaped part 19. In order to avoid formation of a blocking liquid plug during filling, the opening(s) 22 may preferably have a larger total area than that of the openings 23 in the valve means 18.

As shown in the FIGS. 2 and 3 the downwards protruding tube shaped part 19 may at its lower end be provided with a bottom plate 25, the opening 22 being arranged in the bottom plate 25. In order to form a ring shaped tray 27, the bottom plate 25 may preferably be formed with upwards protruding lip(s) 26.

Further, the valve means 18 is provide with a valve body 28 made in a conventional manner and functioning in a conventional way.

During filling the container 10 a supply hose is connected to the valve means 18. The fluid to be filled into the container is then pumped into the container. The fluid will be pumped in through the central, vertical bore 21 at a pressure. At the lower end of the bore 21 the fluid will change direction and will be forced in lateral direction, out through the openings 23 in the valve means and into the tube shaped part 19 and then down into the inner part 13.

When the fluid hits the wall of the downwards protruding part 19, the velocity of the fluid will be reduced and then flow down into the inner part 13 in a manner preventing build-up of electrical or electrostatic potential on the container wall. The electrical or electrostatic potential which possibly is formed, will in such case be formed in the valve means 18 and may possibly in a simple manner be discharged in a known manner by means of an earthed connection.

According to the invention the entire or parts of the inner surface of the container 10 may be provided with a conducting surface or with conductors (not shown) which may be connected to the valve means 18 of metal, whereby an additional earthing is obtained when connected, for example to a earthing pin or plug on the filling station. The conducting area may preferably be arranged on the part of the interior surface of the container to be hit by the jet(s) during the filling operation. The casing 14 may alternatively be made of an electrical conductive material. Such system may be optional, or form an additional safety measure, to the design of the valve means as described above.

The material used in the valve means may preferably be of a type conducting electricity, so that the valve means may be earthed during the fluid charging or fluid discharging operation. The valve means may for example be made of metal or may be provided with a conductor connecting the downwards protruding tubular part 19 with a earthing contact attached to the filling equipment.

According to the embodiment described, the inner part is formed of an inner liner and a surrounding inner part 13, formed of a composite material. It should be appreciated, however, that the inner part 13 may be formed of a body, for example made of different composite materials without deviating from the inventive idea.

Further, it should be appreciated that the surrounding casing 14 may be formed as one integral part or as an assembly of several parts without deviating from the inventive idea. Even though the handle 11 according to the above described embodiment is made as an extension of the surrounding casing 14, it should be appreciated that the handle may be formed and attached to the casing in any suitable way and may be placed at any suitable position on the container 10.

The invention claimed is:

1. A fluid container for storage of fluids, wherein the fluid container is made of thermoplastic materials and fibre composite materials having a low electrical conductivity and wherein the fluid container, at its upper end, is provided with a valve forming a part of the fluid container through which fluid filling and discharging occur, and wherein the fluid container is provided with means for hindering build-up of electrostatic charge during filling operations, said means arranged as an integral part of the upper end of the container wall in association with the valve; said means substantially reducing the fluid velocity and/or changing the direction of the fluid flow during filling.

2. Fluid container according to claim 1, wherein a collar or a cavity is arranged in the fluid container in the region of the valve, and wherein opening(s) of the valve communicate(s) with said cavity.

3. Fluid container according to claim 2, wherein the cavity is provided with at least one opening communicating with the interior of the container.

4. Fluid container according to claim 1, wherein said means comprises a surface surrounding the valve, against which surface the fluid is intended to hit in order to change the direction of flow and/or the velocity of flow into a substantially transverse direction of flow.

5. Fluid container according to claim 1, wherein the means comprises nozzles or openings which completely or partly pulverize the liquid flow.

6. Fluid container according to claim 5, wherein the openings or nozzles form a turbulent flow out of said openings or nozzles.

7. Fluid container according to claim 5, wherein the nozzles or openings produce a laminar flow out of said nozzles or openings.

8. Fluid container according to claim 1, further comprising an outer casing and/or an inner container made of an electrically conducting material or provided with elements or material making the casing and/or the inner container electrically conductive.

9. A method for preventing or reducing build-up of electrical and/or electrostatic potential during filling of a fluid in a container at least partly made of a non-conductive material or semi-conducting material, the fluid being filled at a pressure into the container through a valve integral to the upper end of the container and wherein the valve is provided with a passage, wherein the fluid is made to change direction of flow at least once at the upper end of the container, so that the flow into the container is depressurized and wherein the velocity of liquid flowing into the container is reduced.

10. Method according to claim 9, wherein the direction of fluid flow at an outlet of the valve means is changed from an axial direction with respect to the valve to a lateral direction, perpendicular on the said axial direction, whereupon the direction of flow is then changed back to a flow in said axial direction.

11. A fluid container for storage of fluids, wherein the fluid container is made of thermoplastic materials and fibre composite materials having low electrical conductivity and wherein the fluid container, at its upper end, is provided with a valve forming a part of the fluid container, through which fluid filling and discharging occur, and wherein the fluid container is provided with means for hindering build-up of electrostatic charge during filling operations, wherein the valve comprises ducts and restriction means for reducing build-up of electrical and/or electrostatic potential on the interior wall of the container during filling of the container, said ducts and restriction means being arranged as an integral part of the valve and being configured to substantially reduce the fluid velocity and/or change the direction of the fluid flow during filling.

* * * * *